US005871088A

United States Patent [19]

Tanabe

[11] Patent Number: 5,871,088

[45] Date of Patent: Feb. 16, 1999

[54] EL SHEET DIAPHRAGM AND A SWITCH USING THE SAME

[75] Inventor: Kouji Tanabe, Katano, Japan

[73] Assignee: Matsushita Electric Industrial Co.,Ltd., Osaka, Japan

[21] Appl. No.: 913,821

[22] PCT Filed: Mar. 28, 1996

[86] PCT No.: PCT/JP96/00831

§ 371 Date: Jan. 16, 1998

§ 102(e) Date: Jan. 16, 1998

[87] PCT Pub. No.: WO96/30919

PCT Pub. Date: Oct. 3, 1996

[30] Foreign Application Priority Data

Mar. 30, 1995 [JP] Japan ..... 7-073384

[51] Int. Cl.[6] ..... H01N 9/00; H01H 13/70

[52] U.S. Cl. ..... 200/514; 200/5 A; 200/314; 200/317

[58] Field of Search ..... 29/622; 200/5 R, 200/5 A, 512–517, 310–317; 313/463; 340/825.81; 345/36, 45, 76, 173, 174; 349/69; 365/110, 111; 427/66

[56] References Cited

U.S. PATENT DOCUMENTS

| | | | |
|---|---|---|---|
| 4,320,268 | 3/1982 | Brown | 200/5 A |
| 4,493,958 | 1/1985 | Hamilton et al. | 200/314 |
| 4,532,395 | 7/1985 | Zukowski | 200/314 |
| 4,551,598 | 11/1985 | Hamilton et al. | 200/314 |
| 4,683,360 | 7/1987 | Maser | 200/314 |
| 4,684,353 | 8/1987 | DeSouza | 445/51 |
| 4,719,385 | 1/1988 | Barrow et al. | 313/463 |
| 4,786,767 | 11/1988 | Kuhlman | 200/5 A |
| 4,882,581 | 11/1989 | Inobe et al. | 341/22 |
| 5,557,295 | 9/1996 | Miyashita et al. | 345/36 |

FOREIGN PATENT DOCUMENTS

| | | | |
|---|---|---|---|
| 59-44723 | 3/1984 | Japan | H01H 13/02 |
| 60-86716 | 5/1985 | Japan | H01H 13/02 |
| 1-14648 | 3/1989 | Japan | H01H 13/70 |

*Primary Examiner*—Michael A. Friedhofer
*Attorney, Agent, or Firm*—McDermott, Will & Emery

[57] ABSTRACT

An EL sheet diaphragm including a diffusion type EL sheet having a diaphragm portion exhibiting a dome shape and a flange supporting portion disposed about the outer circumference of the diffusion type EL sheet. The diffusion type EL sheet including a transparent film having an upper surface and a lower surface, a transparent electrode layer formed on the lower surface of the transparent film, a light emitting layer formed on the transparent electrode, a dielectric layer formed on the light emitting layer, a rear electrode layer formed on the dielectric layer, and an insulating layer formed on the rear electrode layer. The diffusion type EL sheet emits light from the diaphragm portion of the upper surface of the transparent film. The diffusion type EL sheet bows outwardly in an at-rest state such that the upper surface of the transparent film exhibits a convex shape, and bows inwardly when depressed for operation such that the upper surface of the transparent film exhibits a concave shape.

40 Claims, 8 Drawing Sheets

EL SHEET DIAPHRAGM AND A SWITCH USING THE SAME

TECHNICAL FIELD OF THE INVENTION

The present invention relates to an EL sheet diaphragm for use as a lighted switch in an input control section of various electronic devices (portable devices, in particular) and a switch using the same.

BACKGROUND OF THE INVENTION

Recently, such electronic devices as communication, video and audio devices are used more and more in portable applications.

A lighted switch in conventional portable electronic devices has been lighted by employing either a bullet-type LED in the vicinity of a contact part of the switch or a chip-type LED in the vicinity of the switch, and providing such light guiding plate as transparent acrylic plate to guide the light to the switch section.

A lighted switch comprising opposing films or glasses with a transparent electrodes on a diffusion-type EL sheet is also known.

However, in such constitution of employing a chip-type LED in the vicinity of the switch, and guiding the light by means of a light guiding plate, it has been a problem that a loss of light and unevenness in brightness are significant, and an attempt of reducing the loss and unevenness causes increase in size and weight, leading to higher power consumption of LED and earlier exhaust of a battery in a portable device, so that the portable device cannot be used continuously for a long time.

A switch with transparent electrodes provided in opposition to each other on an EL sheet is advantageous in that very uniform illumination can be obtained, and a loss is insignificant, while it has been a problem that it lacks operational feeling as a switch.

Further, although a sputtered film of indium tin oxide (hereinafter ITO) is employed as a transparent electrode in a conventional diffusion-type EL sheet, because it is excessively stretched and bent in a process of shaping a diaphragm portion, it has been a problem that ITO may be relatively easily broken during the shaping process or operation of the diaphragm portion, and no light is emitted by the diaphragm portion due to breakage of a binder resin in a light emitting layer or dielectric layer.

SUMMARY OF THE INVENTION

It is an object of the invention to provide a high-quality EL sheet diaphragm and a switch using the same such that a uniform illumination can be achieved, power consumption is reduced, a good operational feeling can be obtained, and light emission failure is reduced.

In order to achieve the object, an EL sheet diaphragm is formed by shaping a diffusion-type EL sheet that comprises a transparent electrode layer formed on a transparent film, a light emitting layer, a dielectric layer, a rear electrode layer and an insulating layer in the form of a dome with a flange-like supporting portion in an outer circumference thereof such that a light emitting surface is in a convex side, and is reversed when it is pressed for operation, and a switch is provided by using the diaphragm.

According to above constitution, a high-quality EL sheet diaphragm and a switch capable of providing uniform illumination, low power consumption and good operational feeling can be obtained.

BEST MODE OF CARRYING OUT THE INVENTION

An EL sheet diaphragm according to an embodiment of the invention and a switch using the same are described below by referring to FIGS. 1 to 7.

(Embodiment 1)

Figure 1:
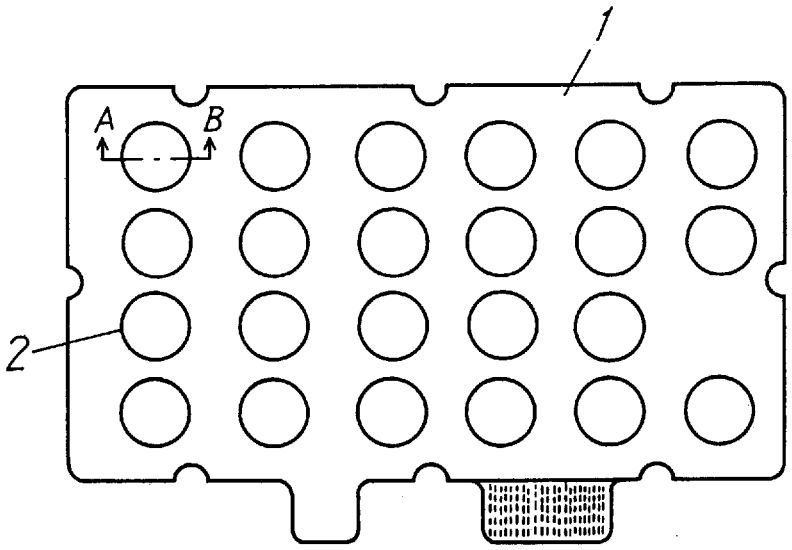
FIG. 1 is an outer plan view of a switch using an EL sheet diaphragm according to an embodiment of the invention.
Figure 2:
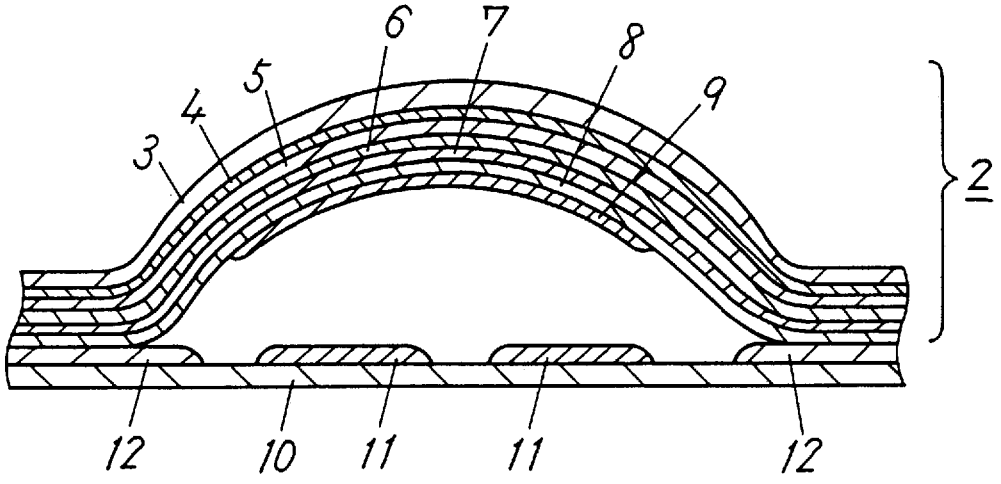
FIG. 2 is a sectional view taken along a line A-B of FIG. 1.
Figure 3:
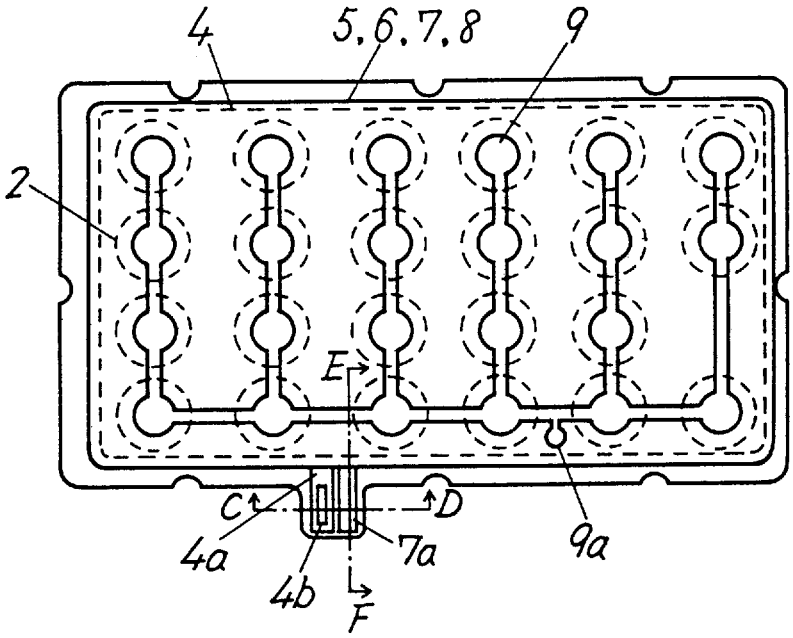
FIG. 3 is a view of a printed pattern in the EL sheet diaphragm.
Figure 4:
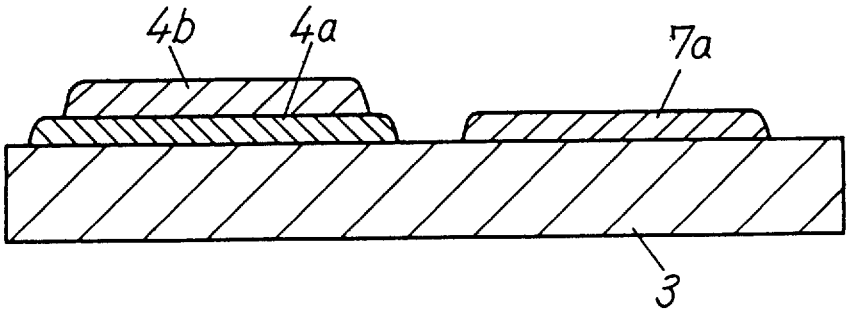
FIG. 4 is a sectional view taken along a line C-D of FIG. 3.
Figure 5:
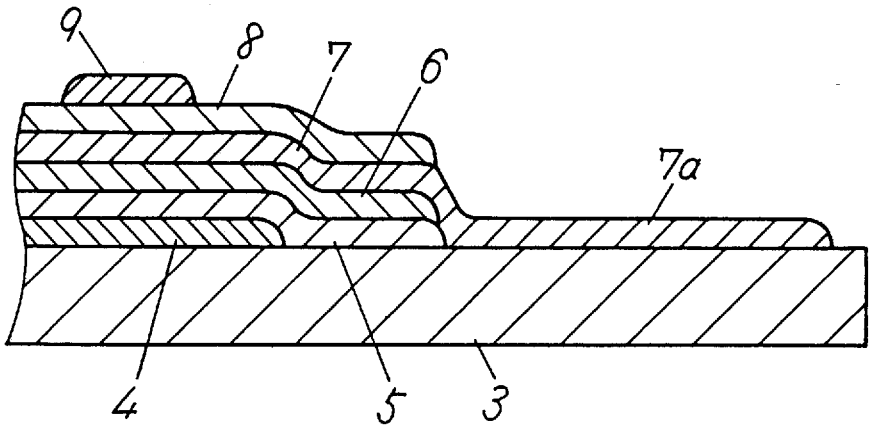
FIG. 5 is a sectional view taken along a line E-F of FIG. 3.
Figure 6:
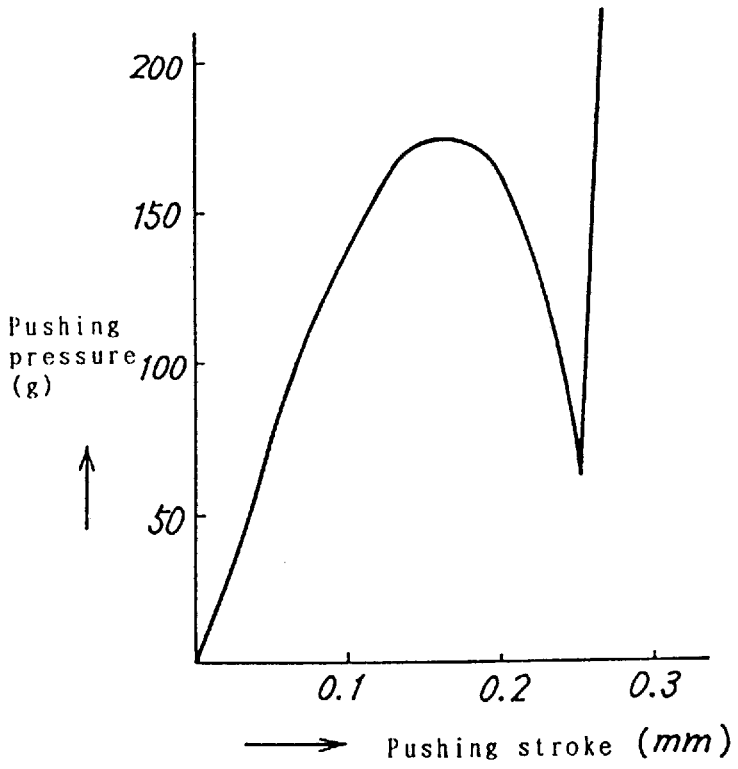
FIG. 6 is a push-down pressure curve in relation to a compression stroke of the diaphragm portion.
Figure 7:
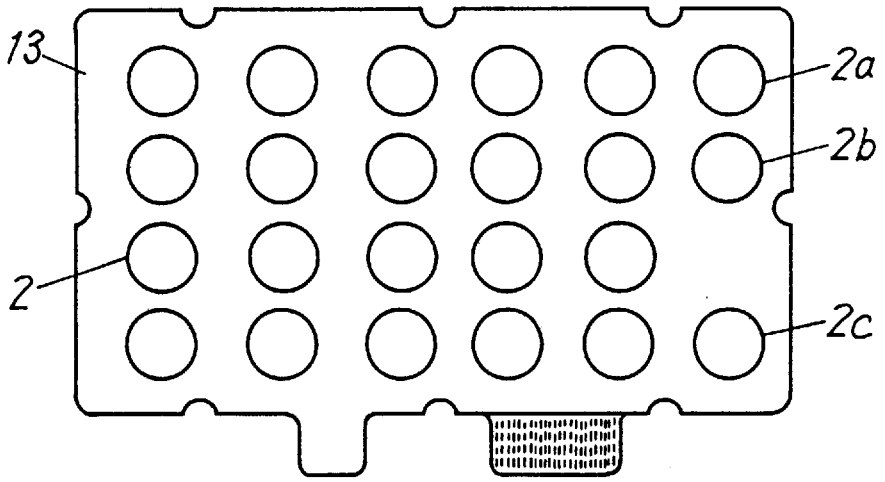
FIG. 7 is an outer plan view of a switch using an EL sheet diaphragm wherein the diaphragm portion is of a multicolor light emitting type.

FIG. 1 is an outer plan view in a convex side of a diaphragm of a switch using an EL sheet diaphragm according to the invention, FIG. 2 is a sectional view taken along a line A-B of FIG. 1, FIG. 3 is a view of a printed pattern in a concave side of the EL sheet diaphragm, FIG. 4 is a sectional view taken along a line C-D of FIG. 3, FIG. 5 is a sectional view taken along a line E-F of FIG. 3, FIG. 6 is a push-down pressure curve in relation to a compressive stroke of the diaphragm portion, and FIG. 7 is an outer plan view of a switch using an EL sheet diaphragm wherein the diaphragm portion is of a multicolor light emitting type.

As shown in FIG. 1, a switch 1 using an EL sheet diaphragm is provided with an illuminatable diaphragm portion 2 that is formed as a laminated member shown in a sectional view of FIG. 2.

The EL sheet comprises a transparent electrode layer 4 formed in a surface of polyethylene terephthalate (hereinafter PET) film 3, which is sequentially laminated by a light emitting layer 5, dielectric layer 6, rear electrode layer 7 and insulating layer 8.

To make the EL sheet, a diffusion-type light transmitting paste prepared by adding 65 wt. % of conductive powders having a visible light transmittance, that is, indium oxide powders (SCP-X prepared by Sumitomo Metal Mining) to an insulating resin (a flexible acrylated bisphenol resin, MRXA prepared by Meiwa Chemical Industry), and dispersing them using three rolls is screen-printed onto the PET film 3 of 125 $\mu$m thick, and dried at 155° C. for 15 min so that the transparent electrode layer 4 of 3 to 5 $\mu$m in dry film thickness is formed.

Then, the light emitting layer 5 is formed in a manner similar to that of forming the transparent electrode layer 4 by printing and drying a paste which is prepared by mixing and dispersing 0.02 g of gicumyl peroxide as a cross linking agent and 100 g of a light emitting element (TYPE 40 prepared by Silvania, U.S.A.) in a vinylidene fluoride copolymer rubber solution (Daiel G902 prepared by Daikin Industries and 35 wt. % of isophorone solved thereto) so that a dry film thickness of 35 $\mu$m is achieved.

Further, the dielectric layer 6 is formed in a similar manner by printing and drying a paste which is prepared by dispersing, using three rolls, 50 g of $BaTiO_3$ (prepared by Kanto Chemical Industry) in 28 g of a mixed solution of 70 wt. % or cyanoethyl pullulan resin and 30 wt. % of cyanoethyl polyvinyl alcohol resin (dimethyl formamide and 35 wt. % of CR-M prepared by Shin-Etsu Chemical that is solved thereto) so that a dry film thickness of 35 μm is achieved.

Thereafter, the rear electrode layer 7 is formed in a similar manner by printing and drying a conductive paste (DY-150H prepared by Toyobo) so that a dry film thickness of 10 μm is obtained.

Finally, the insulating layer 8 is formed similarly by printing and drying an insulating paste (XB-804A prepared by Fujikura Chemical Industry) so that a dry film thickness of 30 μm is achieved.

Next, an upper electrode contact 9 of specified dimensions and a dry film thickness of 8 μm is formed on the insulating layer 8 in a similar manner by drying a conductive paste (DW-250H prepared by Toyobo).

Then, the diaphragm portion 2 is formed by using a mold that is heated to 170° C., and molding it to a dome shape so that it is convex in a side of the PET film 3.

Thereafter, a lower electrode contact 11 is formed by pattern-printing and drying a conductive paste (DW-250H prepared by Toyobo) onto a PET film 10 of 75 μm thick, and the switch 1 using the EL sheet diaphragm is completed by combining the diaphragm portion 2 and a lower electrode contact sheet that is prepared by pattern-printing and drying an insulating paste (XB-804A prepared by Fujikura Chemical Industry) as an insulating resist 12 by means of thermo compression bonding in such manner that the upper electrode contact 9 and lower electrode contact 11 of the diaphragm portion 2 are opposed to each other.

As shown in FIG. 3, the upper electrode contact 9 is pressure-connected at a connection part 9*a* thereof with an external lead pattern of the lower electrode contact sheet, and an electrode lead-out portion of the diaphragm 2 forms, as shown in FIGS. 4 and 5, rear electrode layers 7, 7*a* of a conductive paste and a connecting electrode 4*b* on a light transmitting electrode 4*a* in order for better connection.

In the switch 1 using an EL sheet diaphragm according to the invention, as a result of observing a light emitting condition of EL by applying a power of 100 V 400 Hz to the connecting electrode 4*b* and rear electrode layer 7*a*, reversing the diaphragm portion 2 by pressing the diaphragm portion 2 with a finger from above, and repetitively connecting the upper electrode contact 9 and lower electrode contact 11 (switching operation), it was confirmed that a uniform light was emitted, a light emitted by EL was always uniform even when the switching operation is repeated 500,000 times, and a superior light emitting performance was achieved.

In the embodiment, an El sheet diaphragm may be produced by respectively using, as a binder resin for the light emitting layer 5 and dielectric layer 6), a vinylidene fluoride copolymer rubber (Daiel G501 prepared by Daikin Industries), a mixed resin of 50 wt. % of cyanoethyl pullulan (CR-S prepared by Shin-Etsu Chemical) and 50 wt. % of cyanoethyl polyvinyl alcohol (CR-V prepared by Shin-Etsu Chemical) or a mixed rubber of 50 wt. % of cyanoethyl cellulose (prepared by Shin-Etsu Chemical) and 50 wt. % of cyanoethyl polyvinyl alcohol (CR-V prepared by Shin-Etsu Chemical), and setting the ratio between the light emitting element or dielectric element and the binder resin at the same ratio as that of the embodiment.

As described above, according to the embodiment, breakage of the ITO film during molding of the diaphragm portion 2 can be prevented, and a service life can be increased by printing and drying the paste (diffusion-type light transmitting paste) prepared by dispersing conductive powders that has a visible light transmittance in an insulating resin or a resin solution containing an insulating resin solved therein to form the transparent electrode layer 4, and breakage of a binder resin for the light emitting layer 5 and dielectric layer 6 can be avoided by using, as a binder resin for the light emitting layer 5 and dielectric layer 6, a resin having a high dielectric constant and flexibility, which is selected from a vinylidene fluoride rubber, vinylidene fluoride copolymer rubber, a resin prepared by blending cyanated pullulan and cyanated polyvinyl alcohol or a resin prepared by blending cyanated cellulose and cyanated polyvinyl alcohol.

By molding the diaphragm portion 2 such that clicking is sensed in response to a compressive force, an operational feeling of the switch can be provided, and the diaphragm portion 2 can be molded either by heating the EL sheet to 70° C. to 180° C. or heating the mold to 70° C. to 180° C., so that breakage of the ITO film comprising a diffusion-type light transmitting paste and breakage of the binder resin for the light emitting layer 5 and dielectric layer 6 can be more effectively prevented, and environmental change due to heat and humidity in operational feeling of the molded diaphragm portion 2 can be also minimized, although the diaphragm portion may be molded at an ordinary temperature.

In comparing the diaphragm portion 2 molded at an ordinary temperature and thermally treated at 70° to 95° C. for 30 min with that heated and molded as described above, a difference is significant at a high humidity in particular such that a compressive force of the diaphragm 2 molded at an ordinary temperature and thermally treated is reduced by 30 to 40%, while reduction in that heated and molded is limited to 0 to 10%.

A relation between a compression stroke and push-down pressure in the switch 1 using the EL sheet diaphragm according to above embodiment is shown in FIG. 6.

Further, a color of light emitted by the EL sheet is determined by the light emitting element, and multiple colors can be obtained for the diaphragm portion 2 of the embodiment by employing plural types of light emitting elements, although a light emitting element of ZnS doped with Cu for emission of bluish green light and a light emitting element of ZnS doped with Cu and Mn for emission of orange light are generally used.

The color of light emitted by the EL sheet can be entirely or partly varied by coloring the transparent film of the EL sheet, applying a color paint to the transparent film, or providing a color film over the convex surface of diaphragm 2.

In other words, a switch 13 using a multicolor light emitting EL sheet diaphragm can be obtained in the case a switch 13 is produced by using an EL sheet diaphragm in which the light emitting element of light emitting layer 5 in the diaphragm portions 2*a*, 2*b*, 2*c* shown in FIG. 7 is changed to TYPE 10 prepared by Silvania, U.S.A., such that the diaphragm portions 2*a*, 2*b*, 2*c* are of orange color, and other diaphragm portion 2 is of bluish green when it is allowed to emit a light in a manner similar to that described above.

Also, by employing an acrylic film colored in transparent yellow over the diaphragm portions 2*a*, 2*b*, 2*c*, multicolor light emission can be achieved when it is allowed to emit a light, such that the diaphragm portions 2*a*, 2*b*, 2*c* are of greenish yellow, and other diaphragm portion 2 is of bluish green.

(Embodiment 2)

Figure 8:
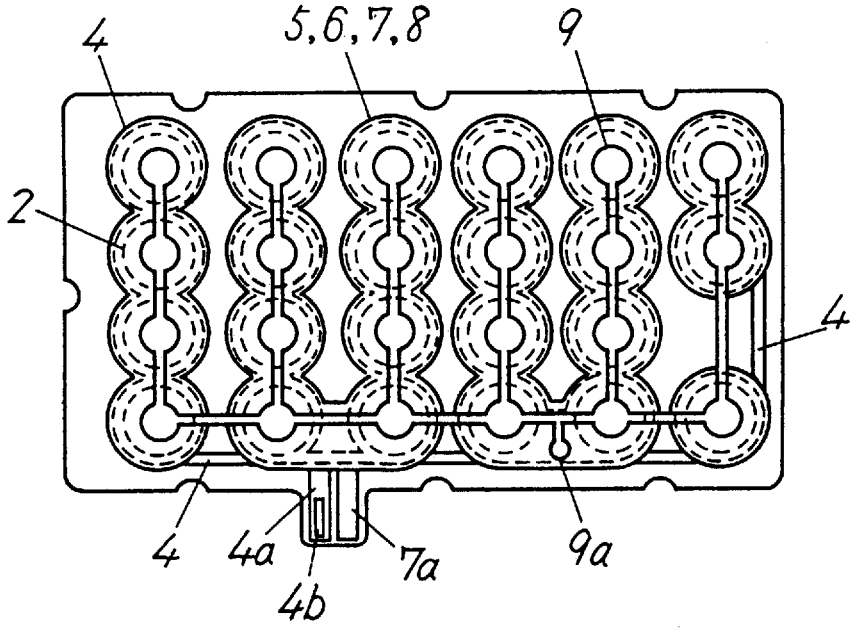
FIG. 8 is a view of a printed pattern in an EL sheet diaphragm according to a second embodiment of the invention.

FIG. 8 is a view of a printed pattern in an EL sheet diaphragm according to the invention.

A second embodiment of the invention is described below.

As shown in FIG. 8, the embodiment provides a switch constructed similarly to that of above embodiment 1 wherein an EL sheet diaphragm is formed with a lighting section comprising a transparent electrode layer 4, a light emitting layer 5, a dielectric layer 6, a rear electrode layer 7 and an insulating layer 8 that are similar to those of above embodiment 1, respectively, only in the diaphragm portion 2 and in the vicinity thereof.

A power consumption of the switch using the EL sheet diaphragm according to the embodiment was about 53% of the power consumption of above embodiment 1.

As described, according to the embodiment, because emission of light is caused only in the diaphragm portion 2 and in the vicinity thereof, although the EL sheet is generally characterized in a low power consumption, the power consumption can be further reduced.

(Embodiment 3)

A third embodiment of the invention is described below.

According to the embodiment, an EL sheet diaphragm was produced by eliminating the electrode contact 9 in above embodiment 1, and molding the diaphragm portion 2 in a manner similar to the embodiment 1.

Then, an electric contact pattern is formed so that it is opposed to upper and lower PET films of 75 $\mu$m each, the EL sheet diaphragm was placed on a membrane switch formed by adhering them except at the electric contact portion with a spacer film between them such that the diaphragm portion is matched with the contact of the membrane switch, thus a switch using the EL sheet diaphragm according to the embodiment was produced. Similarly to above embodiment 1, as a result of observing a light emitting condition of the EL by applying an electric power of 100 V 400 Hz to a connecting electrode 4*b* and rear electrode layer 7*a* of the switch using the EL sheet diaphragm, reversing the diaphragm portion by pressing the diaphragm portion from above with a finger, and allowing the upper and lower contacts to be connected with each other (switching) repetitively, it was confirmed that emission of a light was uniform, and the emission of a light by the EL was always uniform even when the switching operation is repeated 500,000 times.

Industrial Applicability

As described above, the invention provides an EL sheet diaphragm and a switch using the same, wherein a diaphragm portion of a dome shape is molded with a flange-like supporting portion provided in an outer circumference thereof in a diffusion-type EL sheet comprising a transparent electrode layer that is formed on a transparent film, a light emitting layer, a dielectric layer, a rear electrode layer and an insulating layer, so that a light emitting surface is in a convex side, and is reversed when it is pressed for operation.

Thus, according to above constitution, a high quality, superior EL sheet diaphragm capable of achieving uniform lighting, lower power consumption, good operational feeling and reduced light emission failure and a thin, lightweight switch using the same can be provided.

I claim:

1. An EL sheet diaphragm comprising a diffusion type EL sheet having a diaphragm portion exhibiting a dome shape and a flange supporting portion disposed about the outer circumference of said diffusion type EL sheet, said diffusion type EL sheet comprising:

a transparent film having an upper surface and a lower surface, a transparent electrode layer formed on said lower surface of said transparent film, a light emitting layer formed on said transparent electrode layer, a dielectric layer formed on said light emitting layer, a rear electrode layer formed on said dielectric layer, and an insulating layer formed on said rear electrode layer, said diffusion type EL sheet emitting light from at least one selected from the group consisting of (i) the entire area of said EL sheet, (ii) the diaphragm portion only, and (iii) the entire area of said diaphragm portion and an area surrounding said diaphragm portion of said upper surface of said transparent film, said diffusion type EL sheet bowing outwardly in an at-rest state such that said upper surface of said transparent film exhibits a convex shape, said diffusion type EL sheet bowing inwardly when depressed for operation such that said upper surface of said transparent film exhibits a concave shape.

2. An EL sheet diaphragm of claim 1, wherein said transparent electrode layer is formed by printing and drying a paste which is prepared by dispersing conductive powders that have a visible light transmittance in an insulating resin, or in a resin solution containing an insulating resin.

3. An EL sheet diaphragm of claim 2, wherein a binder resin used for said light emitting layer and said dielectric layer is selected from vinylidene fluoride rubber, vinylidene fluoride copolymer rubber, a resin prepared by blending cyanated pullulan and cyanated polyvinyl alcohol, or a resin prepared by blending cyanated cellulose and cyanated polyvinyl alcohol.

4. An EL sheet diaphragm of claim 3, wherein said transparent film comprises polyethylene terephthalate, and said diaphragm portion is molded by heating said EL sheet comprising said transparent film to 70° to 180° C., or heating a mold for said diaphragm portion to 70° to 180° C.

5. An EL sheet diaphragm of claim 4, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

6. An EL sheet diaphragm of claim 3, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

7. An EL sheet diaphragm of claim 2, wherein said transparent film comprises polyethylene terephthalate, and said diaphragm portion is molded by heating said EL sheet comprising said transparent film to 70° to 180° C., or heating a mold for said diaphragm portion to 70° to 180° C.

8. An EL sheet diaphragm of claim 7, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

9. An EL sheet diaphragm of claim 2, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

10. An EL sheet diaphragm of claim 1, wherein a binder resin used for said light emitting layer and said dielectric layer is selected from a vinylidene fluoride rubber, vinylidene fluoride copolymer rubber, a resin prepared by blending cyanated pullulan and cyanated polyvinyl alcohol, or a resin prepared by blending cyanated cellulose and cyanated polyvinyl alcohol.

11. An EL sheet diaphragm of claim 10, wherein said transparent film comprises polyethylene terephthalate, and said diaphragm portion is molded by heating said EL sheet comprising said transparent film to 70° to 180° C., or heating a mold for said diaphragm portion to 70° to 180° C.

12. An EL sheet diaphragm of claim 11, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

13. An EL sheet diaphragm of claim 10, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

14. An EL sheet diaphragm of claim 1, wherein said transparent film comprises polyethylene terephthalate, and said diaphragm portion is molded by heating said EL sheet comprising said transparent film to 70° to 180° C., or heating a mold for said diaphragm portion to 70° to 180° C.

15. An EL sheet diaphragm of claim 14, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

16. An EL sheet diaphragm of claim 1, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

17. A switch comprising an EL sheet diaphragm including a diffusion type EL sheet having a diaphragm portion exhibiting a dome shape and a flange supporting portion disposed about the outer circumference of said diffusion type EL sheet, said diffusion type EL sheet comprising:

a transparent film having an upper surface and a lower surface, a transparent electrode layer formed on said lower surface of said transparent film, a light emitting layer formed on said transparent electrode layer, a dielectric layer formed on said light emitting layer, a rear electrode layer formed on said dielectric layer, and an insulating layer formed on said rear electrode layer, said diffusion type EL sheet emitting light from at least one selected from the group consisting of (i) the entire area of said EL sheet, (ii) the diaphragm portion only, and (iii) the entire area of said diaphragm portion and an area surrounding said diaphragm portion of said upper surface of said transparent film, said diffusion type EL sheet bowing outwardly in an at-rest state such that said upper surface of said transparent film exhibits a convex shape, said diffusion type EL sheet bowing inwardly when depressed for operation such that said upper surface of said transparent film exhibits a concave shape, said switch further comprising a membrane switch disposed below said EL sheet diaphragm, said membrane switch being contacted by said EL sheet diaphragm when said EL sheet diaphragm is depressed.

18. A switch according to claim 17, wherein said transparent film comprises polyethylene terephthalate, and said diaphragm portion is molded by heating said EL sheet comprising said transparent film to 70° to 180° C., or heating a mold for said diaphragm portion to 70° to 180° C.

19. A switch according to claim 18, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

20. A switch according to claim 17, wherein said transparent electrode layer is formed by printing and drying a paste which is prepared by dispersing conductive powders that have a visible light transmittance in an insulating resin or in a resin solution containing an insulating resin.

21. A switch according to claim 20, wherein said transparent film comprises polyethylene terephthalate, and said diaphragm portion is molded by heating said EL sheet comprising said transparent film to 70° to 180° C., or heating a mold for said diaphragm portion to 70° to 180° C.

22. A switch according to claim 21, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

23. A switch according to claim 20, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

24. A switch according to claim 17, wherein a binder resin used for said light emitting layer and said dielectric layer is selected from a vinylidene fluoride rubber, vinylidene fluoride copolymer rubber, a resin prepared by blending cyanated pullulan and cyanated polyvinyl alcohol, or a resin prepared by blending cyanated cellulose and cyanated polyvinyl alcohol.

25. A switch according to claim 24, wherein said transparent film comprises polyethylene terephthalate, and said diaphragm portion is molded by heating said EL sheet comprising said transparent film to 70° to 180° C., or heating a mold for said diaphragm portion to 70° to 180° C.

26. A switch according to claim 25, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

27. A switch according to claim 24, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

28. A switch according to claim 17, wherein said transparent electrode layer is formed by printing and drying a paste which is prepared by dispersing conductive powders that have a visible light transmittance in an insulating resin, or in a resin solution containing an insulating resin and wherein a binder resin used for said light emitting layer and said dielectric layer is selected from vinylidene fluoride rubber, vinylidene fluoride copolymer rubber, a resin prepared by blending cyanated pullulan and cyanated polyvinyl alcohol, or a resin prepared by blending cyanated cellulose and cyanated polyvinyl alcohol.

29. A switch according to claim 28, wherein said transparent film comprises polyethylene terephthalate, and said diaphragm portion is molded by heating said EL sheet comprising said transparent film to 70° to 180° C., or heating a mold for said diaphragm portion to 70° to 180° C.

30. A switch according to claim 29, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

31. A switch according to claim 28, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

32. A switch according to claim 17, wherein at least one color of light is emitted from said light emitting layer of said EL sheet, and said transparent film is colored, a color paint is applied to said transparent film, or a color film is placed on a convex surface of said EL sheet diaphragm so that said color of light emitted by said EL sheet is at least partly changed.

33. A switch comprising an EL sheet diaphragm including a diffusion type EL sheet having a diaphragm portion exhibiting a dome shape and a flange supporting portion disposed about the outer circumference of said diffusion type EL sheet, said diffusion type EL sheet comprising:

a transparent film having an upper surface and a lower surface, a transparent electrode layer formed on said lower surface of said transparent film, a light emitting layer formed on said transparent electrode layer, a dielectric layer formed on said light emitting layer, a rear electrode layer formed on said dielectric layer, an insulating layer formed on said rear electrode layer, and an upper electrode formed on said insulating layer, said diffusion type EL sheet emitting light from at least one selected from the group consisting of (i) the entire area of said EL sheet, (ii) the diaphragm portion only, and (iii) the entire area of said diaphragm portion and an area surrounding said diaphragm portion of said upper surface of said transparent film, said diffusion type EL sheet bowing outwardly in an at-rest state such that said upper surface of said transparent film exhibits a convex shape, said diffusion type EL sheet bowing inwardly when depressed for operation such that said upper surface of said transparent film exhibits a concave shape, said switch further comprising an insulating base film disposed below said EL sheet diaphragm, said insulating base film having a base electrode disposed thereon, said upper electrode and said base electrode contacting one another when said EL sheet diaphragm is depressed.

34. A switch according to claim 33, wherein said transparent electrode layer is formed by printing and drying a paste which is prepared by dispersing conductive powders that have a visible light transmittance in an insulating resin or in a resin solution containing an insulating resin.

35. A switch according to claim 34, wherein said transparent film comprises polyethylene terephthalate, and said diaphragm portion is molded by heating said EL sheet comprising said transparent film to 70° to 180° C., or heating a mold for said diaphragm portion to 70° to 180° C.

36. A switch according to claim 33, wherein a binder resin used for said light emitting layer and said dielectric layer is selected from a vinylidene fluoride rubber, vinylidene fluoride copolymer rubber, a resin prepared by blending cyanated pullulan and cyanated polyvinyl alcohol, or a resin prepared by blending cyanated cellulose and cyanated polyvinyl alcohol.

37. A switch according to claim 36, wherein said transparent film comprises polyethylene terephthalate, and said diaphragm portion is molded by heating said EL sheet comprising said transparent film to 70° to 180° C., or heating a mold for said diaphragm portion to 70° to 180° C.

38. A switch according to claim 33, wherein said transparent electrode layer is formed by printing and drying a paste which is prepared by dispersing conductive powders that have a visible light transmittance in an insulating resin, or in a resin solution containing an insulating resin and wherein a binder resin used for said light emitting layer and said dielectric layer is selected from vinylidene fluoride rubber, vinylidene fluoride copolymer rubber, a resin prepared by blending cyanated pullulan and cyanated polyvinyl alcohol, or a resin prepared by blending cyanated cellulose and cyanated polyvinyl alcohol.

39. A switch according to claim 38, wherein said transparent film comprises polyethylene terephthalate, and said diaphragm portion is molded by heating said EL sheet comprising said transparent film to 70° to 180° C., or heating a mold for said diaphragm portion to 70° to 180° C.

40. A switch according to claim 33, wherein said transparent film comprises polyethylene terephthalate, and said diaphragm portion is molded by heating said EL sheet comprising said transparent film to 70° to 180° C., or heating a mold for said diaphragm portion to 70° to 180° C.

* * * * *